US007237271B1

(12) United States Patent
McLandrich

(10) Patent No.: US 7,237,271 B1
(45) Date of Patent: Jul. 3, 2007

(54) DISPOSABLE PROTECTIVE BIB

(76) Inventor: Andrew Barber McLandrich, 415 Worthington Ave., Cincinnati, OH (US) 45215

( * ) Notice: Subject to any disclaimer, the term of this patent is extended or adjusted under 35 U.S.C. 154(b) by 0 days.

(21) Appl. No.: 11/383,827

(22) Filed: May 17, 2006

(51) Int. Cl.
*A41B 13/10* (2006.01)

(52) U.S. Cl. ..... 2/49.3; 2/49.1

(58) Field of Classification Search ..... 2/49.1, 2/49.2, 49.3, 49.4, 49.5, 48, 51, 52, 50, 75, 2/80; D2/861, 860, 862–864
See application file for complete search history.

(56) References Cited

U.S. PATENT DOCUMENTS

| | | | | | |
|---|---|---|---|---|---|
| 590,991 | A | | 10/1897 | Lenhart | |
| 1,284,252 | A | * | 11/1918 | Dalton | 2/49.3 |
| 2,224,746 | A | * | 12/1940 | Richstein | 2/48 |
| 2,244,656 | A | | 6/1941 | Asch | |
| 2,446,689 | A | * | 8/1948 | Brose et al. | 2/49.5 |
| 2,469,835 | A | * | 5/1949 | McMartin | 2/49.3 |
| 2,532,932 | A | | 12/1950 | Neiswander | |
| 2,551,907 | A | | 5/1951 | Serebrin | |
| 2,637,852 | A | * | 5/1953 | Globe | 2/51 |
| 2,643,384 | A | | 6/1953 | Thompson | |
| 2,762,053 | A | * | 9/1956 | Lipscomb | 2/49.5 |
| 2,900,640 | A | * | 8/1959 | Haydu | 2/49.1 |
| 3,146,464 | A | | 9/1964 | Burnett | |
| 3,328,807 | A | | 7/1967 | Strauss | |
| 3,329,969 | A | | 7/1967 | Farber et al. | |
| 3,945,048 | A | | 3/1976 | Shearer | |
| 3,995,321 | A | | 12/1976 | Johnson | |
| 4,038,697 | A | | 8/1977 | Levitt | |
| 4,114,199 | A | | 9/1978 | Malan | |
| 4,288,877 | A | | 9/1981 | Klepfer | |
| 4,301,544 | A | | 11/1981 | Burton | |
| 4,306,316 | A | | 12/1981 | Klepfer | |
| 4,330,888 | A | | 5/1982 | Klepfer | |
| 4,441,212 | A | | 4/1984 | Ahr et al. | |
| 4,445,231 | A | | 5/1984 | Noel | |
| 4,523,334 | A | | 6/1985 | Lavash | |
| 4,569,086 | A | | 2/1986 | Takefman | |
| 4,601,065 | A | | 7/1986 | Sigl et al. | |
| 4,646,365 | A | | 3/1987 | Surprise et al. | |
| 4,649,572 | A | | 3/1987 | Roessler | |
| 4,660,226 | A | | 4/1987 | Quilling et al. | |
| 4,706,303 | A | | 11/1987 | Van Gompel et al. | |
| 4,793,004 | A | | 12/1988 | Long et al. | |
| 4,860,381 | A | | 8/1989 | Bartley | |

(Continued)

OTHER PUBLICATIONS

"Feeding Accessories", at http://babystore.indiaserver.com/baby-feeding-accessories.html, printed Mar. 20, 2006.

(Continued)

*Primary Examiner*—Amy B. Vanatta
(74) *Attorney, Agent, or Firm*—Donald E. Hasse; Hasse & Nesbitt LLC

(57) ABSTRACT

A disposable protective bib comprises a generally rectangular sheet of flexible, liquid-impervious material. The bib has a top portion comprising a yoke to accommodate the user's neck and a bottom portion comprising at least one fastening element for securing the bib to a table. The bib forms a pocket between the wearer and the table to catch food and beverages that may be spilled. The yoke comprises at least one perforated tear section to release the bib from the wearer.

16 Claims, 3 Drawing Sheets

U.S. PATENT DOCUMENTS

| | | | |
|---|---|---|---|
| 4,884,299 | A | 12/1989 | Rose |
| 4,924,527 | A | 5/1990 | Hintermeyer |
| 4,924,528 | A | 5/1990 | Trombetti-Dickens |
| D310,597 | S | 9/1990 | Long et al. |
| 5,031,241 | A | 7/1991 | Wiedemann |
| 5,056,159 | A | 10/1991 | Zemke, Jr. |
| 5,062,558 | A | 11/1991 | Stang |
| 5,457,820 | A | 10/1995 | Yielding |
| 5,491,844 | A | 2/1996 | Kehl et al. |
| 5,671,479 | A | 9/1997 | Dedrick |
| H1738 | H | 7/1998 | Reinhart, Jr. |
| 5,887,278 | A | 3/1999 | Lewis et al. |
| 5,915,530 | A | 6/1999 | Hager |
| 5,930,836 | A | 8/1999 | Morris |
| 5,956,763 | A | 9/1999 | Blackshear |
| 6,021,521 | A | 2/2000 | Baratta |
| 6,058,506 | A | 5/2000 | Reinhart, Jr. |
| 6,081,923 | A | 7/2000 | Marks |
| 6,105,165 | A | 8/2000 | Johnson et al. |
| 6,128,780 | A | 10/2000 | Reinhart et al. |
| 6,128,781 | A | 10/2000 | Spindler |
| 6,182,290 | B1 | 2/2001 | Morris |
| 6,237,150 | B1 | 5/2001 | Lucas |
| 6,256,788 | B1 | 7/2001 | Loewer et al. |
| 6,317,890 | B1 | 11/2001 | Kuhn |
| 6,334,220 | B1 * | 1/2002 | Frye ..... 2/49.2 |
| 6,374,411 | B1 | 4/2002 | Duhn |
| 6,381,751 | B1 | 5/2002 | Benjamin et al. |
| 6,493,879 | B1 | 12/2002 | Hibler |
| 6,499,140 | B1 | 12/2002 | Benjamin et al. |
| D473,364 | S * | 4/2003 | Conte ..... D2/864 |
| 6,581,210 | B2 | 6/2003 | Kaloustian |
| 6,708,341 | B1 | 3/2004 | Schaller |
| 6,732,375 | B2 | 5/2004 | Nornes |
| D491,342 | S | 6/2004 | Jordan |
| 6,789,265 | B1 | 9/2004 | Vonrinteln |
| 6,826,780 | B1 | 12/2004 | Romesburg |
| 2003/0074710 | A1 | 4/2003 | Sanders et al. |
| 2005/0120457 | A1 | 6/2005 | Mesalic |

OTHER PUBLICATIONS

"Cool Items for Kids and Parents", discussing Neat Solutions' Table Topper at http://www.cbsnews.com/stories/2004/03/22/earlyshow/contributors/lauriehibberd/main608079.shtml.

* cited by examiner

DISPOSABLE PROTECTIVE BIB

TECHNICAL FIELD

The present invention relates to a disposable protective bib, and more particularly, to a one piece disposable protective bib having a top portion comprising a yoke to accommodate the user's neck and a bottom portion comprising at least one fastening element for securing the bib to a table. In use, the bib forms a pocket between the wearer and the table to catch food and beverages that may be spilled. The yoke comprises at least one perforated tear section to release the bib from the wearer.

BACKGROUND OF THE INVENTION

U.S. Pat. No. 4,114,199 discloses a disposable bib tray produced from a single flat piece of stiff sheet material such as paper. The bib tray design requires material of a certain stiffness, and films made from commonly used materials such as polyethylene and polyvinylchloride are unsuitable. As a result, this bib tray cannot be easily packaged in roll form. Moreover, assembly of such a bib tray requires cutting and folding, making it inconvenient to use and relatively expensive.

Disposable protective bibs having pockets for catching falling and spilled food are disclosed in U.S. Pat. Nos. 3,995,321 and 3,945,048. However, the pockets may not adequately protect the lap area from spills when the wearer is in a variety of sitting or semi-prone positions, and provide only a limited amount of surface area to catch and hold spills.

Accordingly, there is a continuing need for an inexpensive, one piece, disposable bib that can be conveniently packaged on a roll and that can protect the lap area from spills, especially when worn by an elderly or infirmed adult in a health care center, nursing home, or restaurant.

SUMMARY OF THE INVENTION

The present invention relates to a disposable protective bib comprising a generally rectangular sheet of flexible, liquid-impervious material having a top portion comprising a yoke to accommodate the user's neck and a bottom portion comprising at least one fastening element for securing the bib to a table and forming a pocket between the wearer and the table to catch food and beverages that may be spilled, wherein said yoke comprises at least one perforated tear section to release the bib from the wearer.

In one embodiment, the invention relates to a reversible, disposable protective bib comprising a generally rectangular sheet of flexible, liquid-impervious plastic material having a top portion comprising a yoke to accommodate the user's neck and a bottom portion comprising at least one adhesive fastening element for securing the bib to a table and forming a continuous pocket between the wearer and the table to catch food and beverages that may be spilled, wherein said yoke comprises first and second ties for securing the bib to the wearer and said ties comprise perforated tear sections adjacent the shoulders to release the bib from the wearer.

DETAILED DESCRIPTION OF THE INVENTION

As used herein, the term "disposable" refers to structures that are intended to be discarded after a single use or a few uses (i.e., they are not intended to be cleaned, laundered or otherwise restored and/or reused after use). Such structures may be recycled, composted or otherwise disposed of in an environmentally compatible manner. While the articles described herein are typically disposable, they may be cleaned, laundered, restored and/or reused many times.

Figure 1:
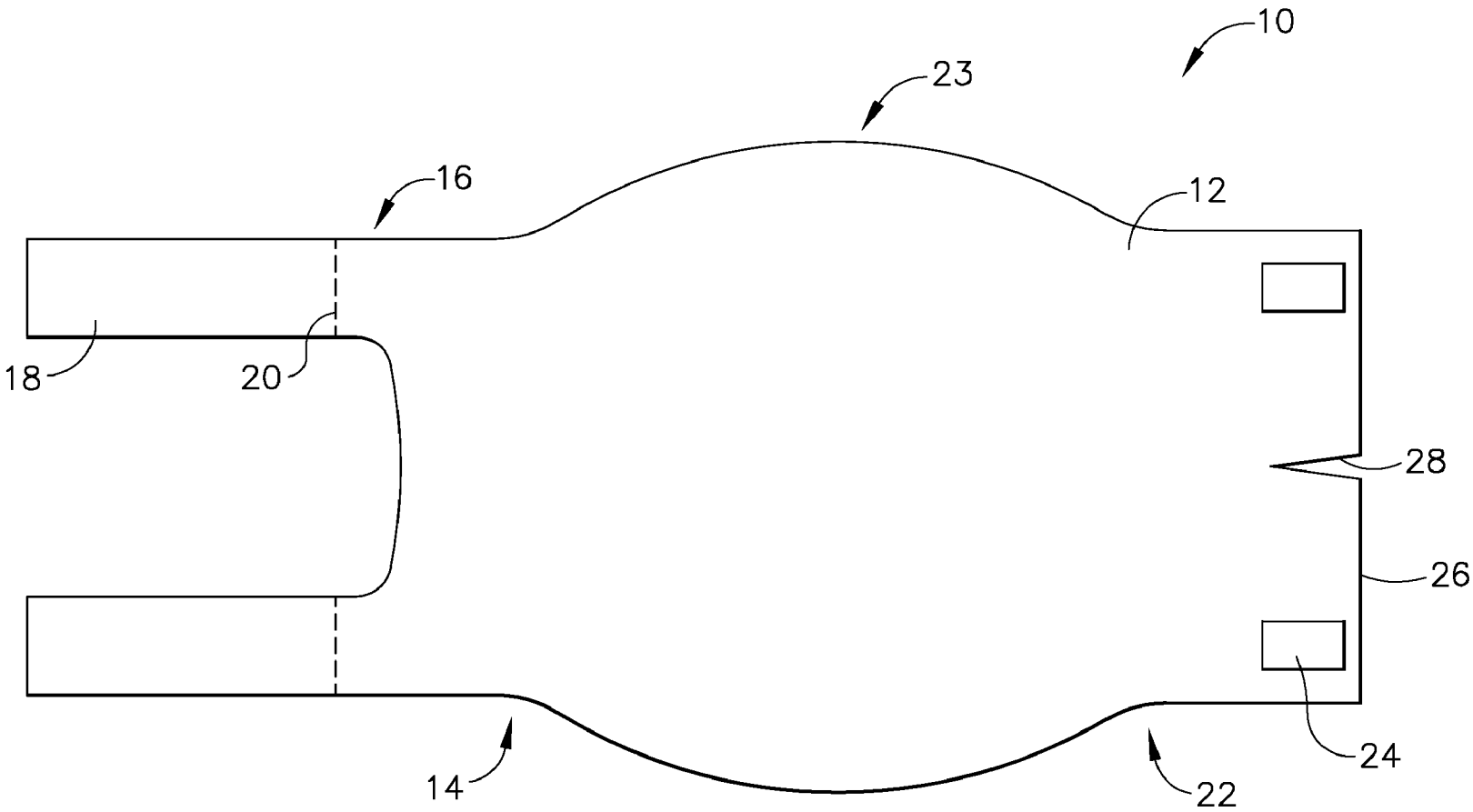
FIG. 1 is a plan view of a disposable protective bib according to one embodiment of the invention.

Referring now to FIG. 1, a disposable protective bib of the invention, such as bib 10, comprises a generally rectangular sheet, such as sheet 12, of flexible, liquid-impervious material that covers the chest, stomach and lap of the wearer. During use, the bib bridges the gap between the wearer and the table, thus forming a continuous membrane pocket that shields and protects the wearer and the floor from food and beverages that may be spilled.

In one embodiment, the sheet 12 is made of flexible, liquid-impermeable material, typically a plastic such as polystyrene, polyethylene, polypropylene, or biodegradable plastic (e.g., made from corn starch). Alternatively, the sheet may comprise woven, nonwoven or knit fabrics that are liquid-impermeable on at least the side opposite the body-facing side of the sheet. The sheet typically has a thickness of less than about 1 mm, more typically less than about 0.5 mm, e.g., less than about 0.3 mm. Typically, the sheet is a polyethylene film having a thickness of from about 0.05 mm to about 0.25 mm. Suitable polyethylene films are manufactured by Clopay Corporation. The sheet may be embossed and/or matte finished to provide a more cloth like appearance. The sheet 12 and the bib 10 may be transparent, translucent or opaque, and may have a variety of colors, logos or designs printed thereon for promotions and advertising.

The bib 10 has a top portion 14 comprising a yoke, such as yoke 16, to accommodate the user's neck. The yoke may be of various sizes, shapes and designs. In FIG. 1, the yoke comprises first and second ties 18 for securing the bib around the neck of the wearer. In another embodiment, the yoke comprises a continuous collar that can be slipped over the head of the wearer.

The yoke comprises at least one perforated tear section, such as perforated tear section 20, that can be torn to release the bib from the wearer. The perforated tear section typically is adjacent the shoulder when the bib is worn. When the wearer is finished eating or drinking and ready to leaving the dining area, the wearer or care provider can easily tear the yoke along the perforated tear section. The perforated tear section may comprise a slit, point or section to initiate tearing. In the embodiment shown in FIG. 1, the ties 18 comprise perforated tear sections 20 adjacent the shoulders when the bib is worn.

The bib 10 also has a bottom portion, such as bottom portion 22, comprising at least one fastening element, such as fastening element 24, for securing the bib to a table. The fastening element typically is located adjacent the distal end of the bib, such as at distal end 26. The fastening element may comprise any mechanical or adhesive fastening system known in the art, including various hook and loop fasteners, snaps, catches, hooks, adhesives, and the like. In one embodiment, the fastening element comprises one or more adhesive elements that can be affixed to the top or bottom of the table, which may be fitted with one or more corresponding fastening elements. The bib can thus be designed to be reversible. As shown in FIG. 1, the bottom portion 22 of the bib may comprise two fastening elements 24, such as adhesive patches, which may comprise release paper or a pressure sensitive adhesive. In one embodiment, the adhesive element comprises release paper that can be removed to expose the adhesive that can be secured to the table. In another embodiment, the bottom portion of the bib comprises a single adhesive strip that extends along a portion of the distal end of the bib.

Figure 2:
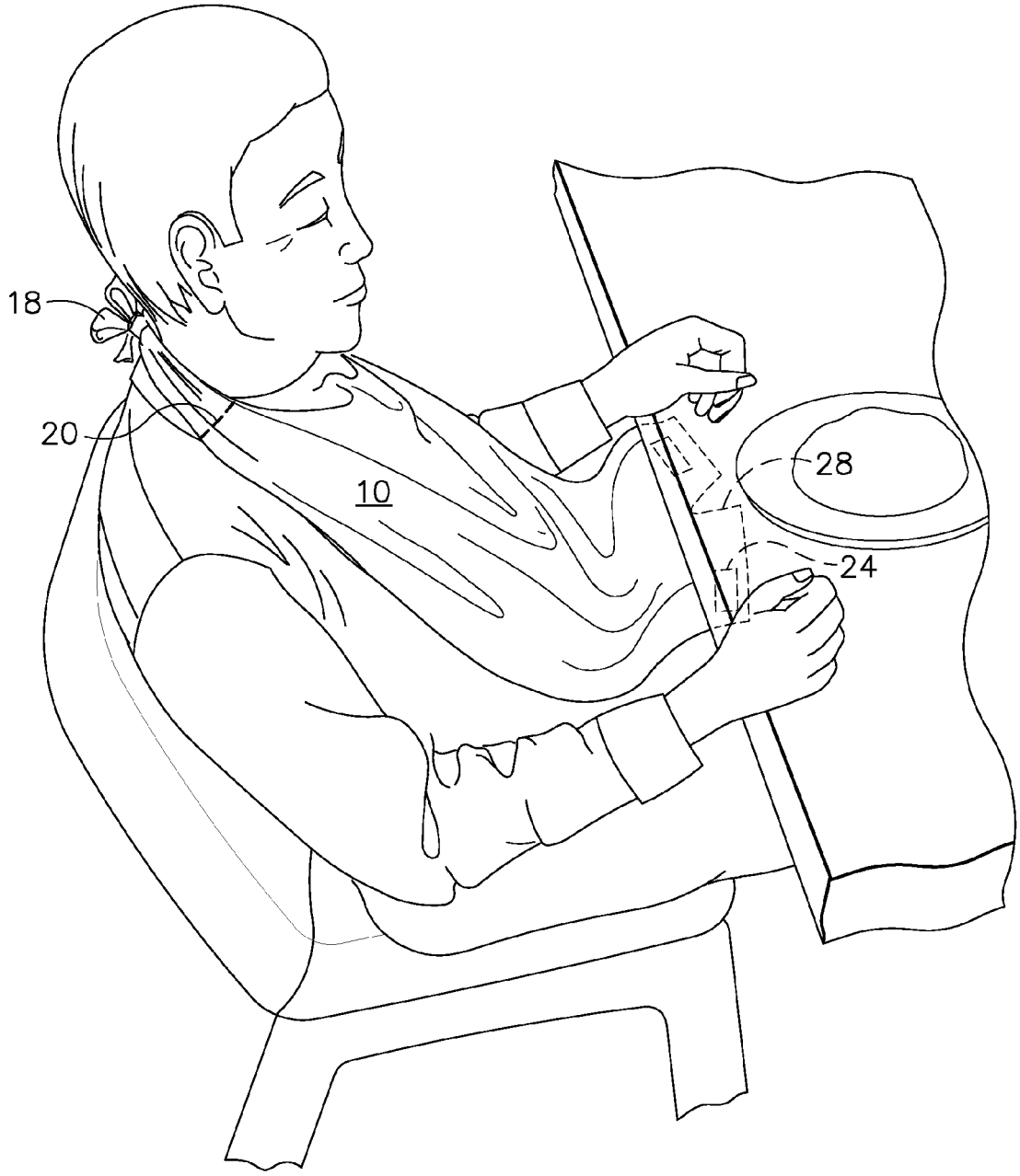
FIG. 2 is a perspective view of the bib of FIG. 1 being worn, with the bottom portion of the bib comprising fastening elements secured to the bottom of a table.

In use, the bib is secured around the neck of the wearer and the at least one fastening element on the bottom portion of the bib is secured to the table after the wearer is positioned the desired distance from the table. The fastening element or elements are positioned such that a continuous membrane pocket is formed between the wearer and the table to catch food and beverages that may be spilled. FIG. 2 is a perspective view of the bib 10 of FIG. 1 being worn, with the bottom portion of the bib comprising fastening elements 24 secured to the bottom of a table. In one embodiment, the central portion of the bib between the top portion and the bottom portion, such as central portion 23 shown in FIG. 1, is wider than the top and bottom portions to provide increased coverage of the stomach and lap areas of the wearer. Such a bib typically forms a more spacious pocket for catching spilled food and beverages, and thus provides additional protection against spills.

Upon removal of the bib from the wearer, the spilled food and/or beverage can be wrapped inside the bib to avoid being spilled on the wearer or the floor. If the wearer forgets to remove the bib before attempting to get up from the table, the bottom portion of the bib remains attached to the table and the backward and/or upward force exerted by the wearer will cause the perforated tear section or sections to tear and at least partially release the bib from the wearer. Such tearing of the bib typically will avoid causing items on the table to be spilled or pulled onto the wearer or the floor. The wearer, caregiver or waiter may then be reminded to wrap any spilled food or beverage in the pocket of the bib to avoid spillage on the wearer or the floor. The inexpensive bib may then be disposed of after a single use, or it may be emptied and cleaned for reuse.

In one embodiment, the bottom portion of the bib further comprises a centrally located distal slit generally perpendicular to the portion of the bib secured to the table. For example, the bottom portion 22 of the bib in FIG. 1 comprises a centrally located distal slit 28 that is generally perpendicular to the portion of the bib that is secured to the table. Such a slit helps insure that the fastening element or elements can be secured to the table in a manner such that a pocket is formed between the wearer and the table to catch food and beverages that may be spilled. The bottom portion of the bib typically is positioned and secured to the table in a manner such that the slit is completely under (or over) the table so that a continuous pocket is formed between the wearer and the table. FIG. 2 illustrates positioning of the fastening elements 24 and the slit 28 to form such a pocket.

It will be appreciated that the disposable protective bib herein may have other designs, styles and configurations besides those shown and described. For example, the bib may comprise one or more straps, strings, ties, panels, or cutout areas, so long as these do not significantly interfere with the function of the bib.

The disposable protective bib of the invention can be made by various methods known in the art. For example, a flat rectangular piece of polyethylene may be cut to the shape of bib 10 in FIG. 1. Perforated tear sections 20 may be formed in the ties 18, and fastening elements 24, such as adhesive patches, may be glued to the bottom portion of the bib. A centrally located slit 28 may then be cut in the distal end of the bib. The bib may be connected to other bibs on a roll for dispensing, or the bibs may be stacked or inter-folded and dispensed from a box or other container.

Figure 3:
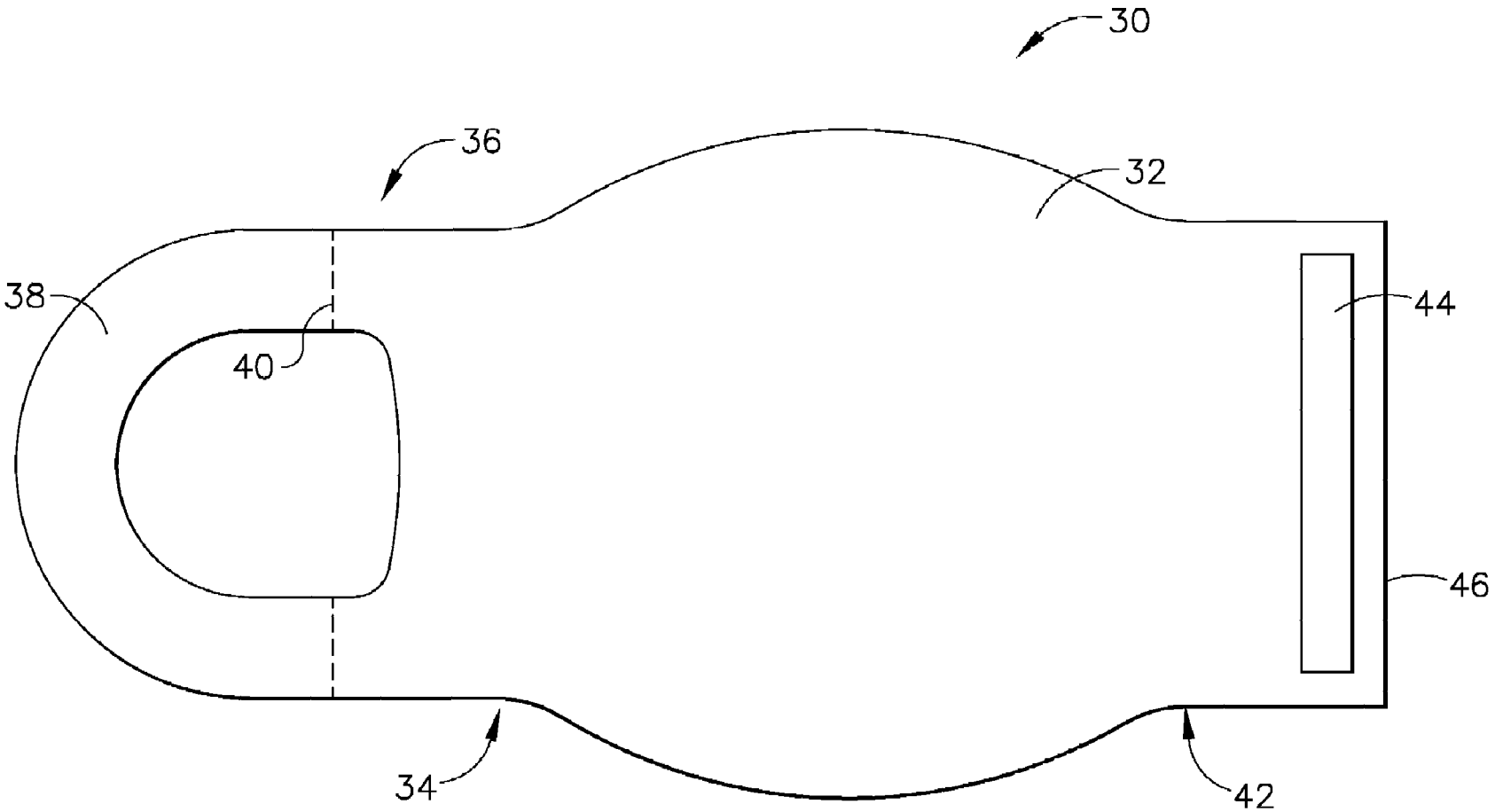
FIG. 3 is a plan view of another disposable protective bib of the invention.

FIG. 3 is a plan view of another disposable protective bib 30 of the invention. Bib 30 comprises a generally rectangular sheet, such as sheet 32, of flexible, liquid-impervious material as described above that covers the chest, stomach and lap of the wearer and protects the wearer and the floor from food and beverages that may be spilled. The bib 30 has a top portion 34 comprising a yoke, such as yoke 36, to accommodate the user's neck. The yoke may be of various sizes, shapes and designs. In FIG. 3, the yoke comprises a continuous collar 38 that can be slipped over the head of the wearer. In another embodiment, the yoke comprises ties for securing the bib around the neck of the wearer.

The yoke comprises at least one perforated tear section, such as perforated tear section 40, which can be torn to release the bib from the wearer. The perforated tear section typically is adjacent the shoulder when the bib is worn. When the wearer is finished eating or drinking and ready to leaving the dining area, the wearer or care provider can easily tear the yoke along the perforated tear section. The perforated tear section may comprise a slit, point or section to initiate tearing. In the embodiment shown in FIG. 1, the perforated tear sections 40 are adjacent the shoulders when the bib is worn.

The bib 30 also has a bottom portion, such as bottom portion 42, comprising at least one fastening element, such as fastening element 44, for securing the bib to a table. The fastening element typically is located adjacent the distal end of the bib, such as at distal end 46. The fastening element may comprise any mechanical or adhesive fastening system. In one embodiment, the fastening element comprises one or more adhesive elements that can be affixed to the top or bottom of the table, which may be fitted with one or more corresponding fastening elements. As shown in FIG. 3, the bottom portion 42 of the bib comprises a fastening element 44, such as an adhesive patch, which may comprise release paper or a pressure sensitive adhesive. In one embodiment, the adhesive element comprises release paper that can be removed to expose the adhesive that can be secured to the table. In another embodiment, the bottom portion of the bib may comprise adhesive patches that extend along a portion of the distal end of the bib. As described above, the bib may be connected to other bibs on a roll for dispensing, or the bibs may be stacked or inter-folded and dispensed from a box or other container.

While particular embodiments of the present invention have been illustrated and described, various other changes and modifications can be made without departing from the spirit and scope of the invention. It is therefore intended to cover all such changes and modifications that are within the scope of this invention.

What is claimed is:

1. A disposable protective bib comprising a generally rectangular flat sheet of flexible, liquid-impervious plastic material having a top portion comprising a yoke to accommodate the user's neck and a bottom portion comprising at least one fastening element that can be affixed to the top or bottom of a table for securing the bib to the table and forming a pocket between the wearer and the table to catch food and beverages that may be spilled, wherein said yoke comprises at least one perforated tear section to release the bib from the wearer, and wherein the bottom portion of the bib further comprises a centrally located distal slit generally perpendicular to the portion of the bib secured to the table.

2. A disposable protective bib according to claim 1 wherein the at least one perforated tear section is adjacent the shoulder when the bib is worn.

3. A disposable protective bib according to claim 1 wherein the yoke comprises first and second ties for securing the bib around the neck of the wearer.

4. A disposable protective bib according to claim 3 wherein the ties comprise perforated tear sections adjacent the shoulders when the bib is worn.

5. A disposable protective bib according to claim 1 wherein the at least one fastening element comprises at least two adhesive elements comprising release paper or a pressure-sensitive adhesive.

6. A disposable protective bib according to claim 1 wherein the sheet has a thickness of less than about 1.0 mm.

7. A disposable protective bib according to claim 6 wherein the sheet has a thickness of less than about 0.5 mm.

8. A disposable protective bib according to claim 6 wherein the sheet is polystyrene, polyethylene, polypropylene, or biodegradable plastic.

9. A disposable protective bib according to claim 1 that is reversible.

10. A disposable protective bib according to claim 1 that forms a continuous pocket between the wearer and the table when the bib is worn and secured to the table.

11. A reversible, disposable protective bib comprising a generally rectangular flat sheet of flexible, liquid-impervious plastic material having a top portion comprising a yoke to accommodate the user's neck and a bottom portion comprising at least one adhesive fastening element that can be affixed to the top or bottom of a table for securing the bib to the table and forming a continuous pocket between the wearer and the table to catch food and beverages that may be spilled, wherein said yoke comprises first and second ties for securing the bib around the neck of the wearer and said ties comprise perforated tear sections adjacent the shoulders to release the bib from the wearer, and wherein the bottom portion of the bib further comprises a centrally located distal slit generally perpendicular to the portion of the bib secured to the table.

12. A disposable protective bib according to claim 11 wherein the at least one adhesive fastening element comprises release paper or a pressure-sensitive adhesive.

13. A disposable protective bib according to claim 11 wherein the sheet has a thickness of less than about 0.5 mm.

14. A disposable protective bib according to claim 11 wherein the sheet is polystyrene, polyethylene, polypropylene, or biodegradable plastic.

15. A disposable protective bib according to claim 11 wherein the at least one adhesive fastening element comprises release paper or a pressure-sensitive adhesive and can be affixed to the top or bottom of the table.

16. A disposable protective bib according to claim 15 wherein the sheet is polystyrene, polyethylene, polypropylene, or biodegradable plastic, and has a thickness of less than about 0.5 mm.

* * * * *